US005957514A

United States Patent [19]

Brookshire

[11] Patent Number: 5,957,514

[45] Date of Patent: Sep. 28, 1999

[54] BATH DRAIN BUCKET RETRIEVER

[76] Inventor: Danny A. Brookshire, 694 Medford St., El Cajon, Calif. 92020

[21] Appl. No.: 08/878,275

[22] Filed: Jun. 18, 1997

[51] Int. Cl.[6] ..... B25J 1/02

[52] U.S. Cl. ..... 294/19.1; 81/119; 81/177.75; 294/90

[58] Field of Search ..... 294/1.1, 19.1, 294/26, 86.1, 86.26, 86.33, 86.4, 90; 15/104.03, 104.05, 104.09, 104.31–104.33; 81/177.75, 119, 487, 488

[56] References Cited

U.S. PATENT DOCUMENTS

| | | | |
|---|---|---|---|
| 1,612,713 | 12/1927 | Fienberg | 81/177.75 |
| 1,643,855 | 9/1927 | Peterson | 81/177.75 |
| 1,807,625 | 6/1931 | Hjorth | 81/119 X |
| 1,875,376 | 9/1932 | Hamer et al. | 294/19.1 |
| 2,051,700 | 8/1936 | Grace | 15/104.32 |
| 2,436,336 | 2/1948 | Slater | 81/177.75 X |
| 4,075,913 | 2/1978 | Tye | 294/19.1 X |
| 4,573,378 | 3/1986 | McDonald | 294/19.1 X |

*Primary Examiner*—Johnny D. Cherry
*Attorney, Agent, or Firm*—Frank D. Gilliam

[57] ABSTRACT

A tool for retrieving bathtub drain internal stoppers or plungers, generally known as "buckets", that slide along a tube to open and close the drain. The tool has a handle on one end, a tool head on the other end for engaging a crossbar on the drain bucket and a series of links in between, all connected by universal joints. The head has a hook-like assembly that is slid into a pipe until the head engages the bucket crossbar. The handle is used to alternately rotate the assembly clockwise and counter clockwise to loosen the bucket, then the hook connects to the crossbar to pull the bucket from the pipe.

13 Claims, 2 Drawing Sheets

BATH DRAIN BUCKET RETRIEVER

FIELD OF THE INVENTION

This invention relates to plumbing repair tools for retrieving internally jammed bath drain stoppers or plungers that are generally referred to as "buckets."

BACKGROUND OF THE INVENTION

Conventional drains for bathtubs, showers and the like include a drain opening in the lowest area of the tub. The drain opening is connected to a slightly sloping horizontal pipe that connects to a vertically positioned pipe that connects to a vertically positioned fitting called a tee. This tee accommodates the horizontal drain pipe, the upper vertical overflow pipe and the lower vertical waste pipe that goes to the trap and then out to the sewer line. One standard apparatus for opening and closing flow through the drain opening uses a plunger tube or sleeve, generally referred to as a "bucket". The bucket is movable between a lower position in the vertical pipe to block flow of water from the horizontal pipe into the vertical tee and an upper position in which flow is unimpeded by a lever or other means.

The bucket sometimes becomes stuck in one of the two positions. The bucket must fit snugly in the vertical tee so that leakage will not occur in the closed position. The bucket may become stuck because of contamination entering between bucket and pipe, such as hard water deposits, soap, etc.

When there is a clog in the vertical pipe downstream of the bucket, a plumber's snake must be inserted to clear the blockage. While it is sometimes possible to insert the snake through the drain opening, this is often very difficult because of the number of right-angle turns the snake must make between the drain and the vertical pipe. Removing the lever mechanism, linkage and bucket will permit the snake to be inserted essentially straight into the vertical tee through the opening in which the lever mechanism is mounted.

When the bucket is tightly stuck in place, it cannot be moved between open and closed positions and cannot be removed to permit introduction of the snake. In attempting to raise the bucket by pulling on the linkage between the bucket and the control lever mechanism, the linkage is often broken, generally at the point where the linkage connects to the bucket. Then an opening must be broken into the wall at the point where the horizontal and vertical pipes come together and the tub waste and overflow devices must be replaced. After repairs are made, the wall and any underlying ceiling must also be repaired.

This repair is both time consuming and expensive. Therefore, there is an urgent need for a tool that will effectively loosen a stuck bucket and remove it through the lever mechanism opening. The tool must be sturdy, easily insertable into the vertical pipe and brought into connection with the bucket. The tool must be convenient to use in loosening and removing the stuck bucket and work well with a wide variety of bucket and tee designs.

SUMMARY OF THE INVENTION

The above-noted problems, and others, are overcome by an internal bucket retrieval tool that basically comprises a handle, a series of links connected by universal joints and a bucket bar engaging tool head. The head comprises two tool pieces extending from a base to fit around both sides of the bucket bar and latchingly engage the bucket bar in a manner allowing the bar and bucket to be alternately twisted in clockwise and counter-clockwise directions until the bucket is broken loose, allowing the bucket to be withdrawn through the vertical tube and lever mechanism opening.

The series of links is joined at the proximal end to the handle and at the distal end to the tool head. The tool head comprises a base having a proximal end configured to form a universal joint with the distal end link. The distal end of said head comprises latching means for connection to a bucket bar for rotating the bucket both clockwise and counter clockwise and for withdrawing the bucket.

The latching means includes a first tool piece having a post extending away from the second base end, opposite the first base end. A transverse segment extends from the distal post end approximately at a right angle to the post. A return segment is secured to the distal end of the transverse segment with the return segment distal end extending back toward the base. The first tool piece, comprising post, transverse segment and return segment, preferably lies in one plane.

The second tool piece comprises a peg secured to the base spaced from the plane of the first tool piece. Preferably, the peg lies on a line perpendicular to the first tool piece plane, the perpendicular line extending from about the location of the return segment.

For optimum performance, the base is generally cylindrical, with the base universal joint connection approximately on the cylinder centerline at the first end of the tool head. On the second tool end, the first and second tool pieces are preferably spaced apart on opposite sides of the cylindrical centerline. This space between first and second tool pieces is equal to or slightly greater than the width of the bucket crossbar with which the tool is to be used.

In use, the tool is inserted until the first and second tool pieces are positioned on opposite sides of the bucket crossbar. The entire tool is then rotated back and forth alternately attempting to rotate the crossbar in each direction. The post and peg engage the crossbar, transmitting force thereto. Once the bucket has been loosened, the tool is rotated in the direction such that the crossbar is under the transverse segment. When the tool is pulled out of the vertical tube, the crossbar is held securely against the transverse segment between the hook-like first tool piece.

After removal of a clog with a snake and cleaning of the vertical tube interior wall and the outside wall of the bucket (or replacement with a new bucket), a bucket is then connected to a new or refurbished lever mechanism and linkage and returned into the vertical tube.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figures 1, 3:
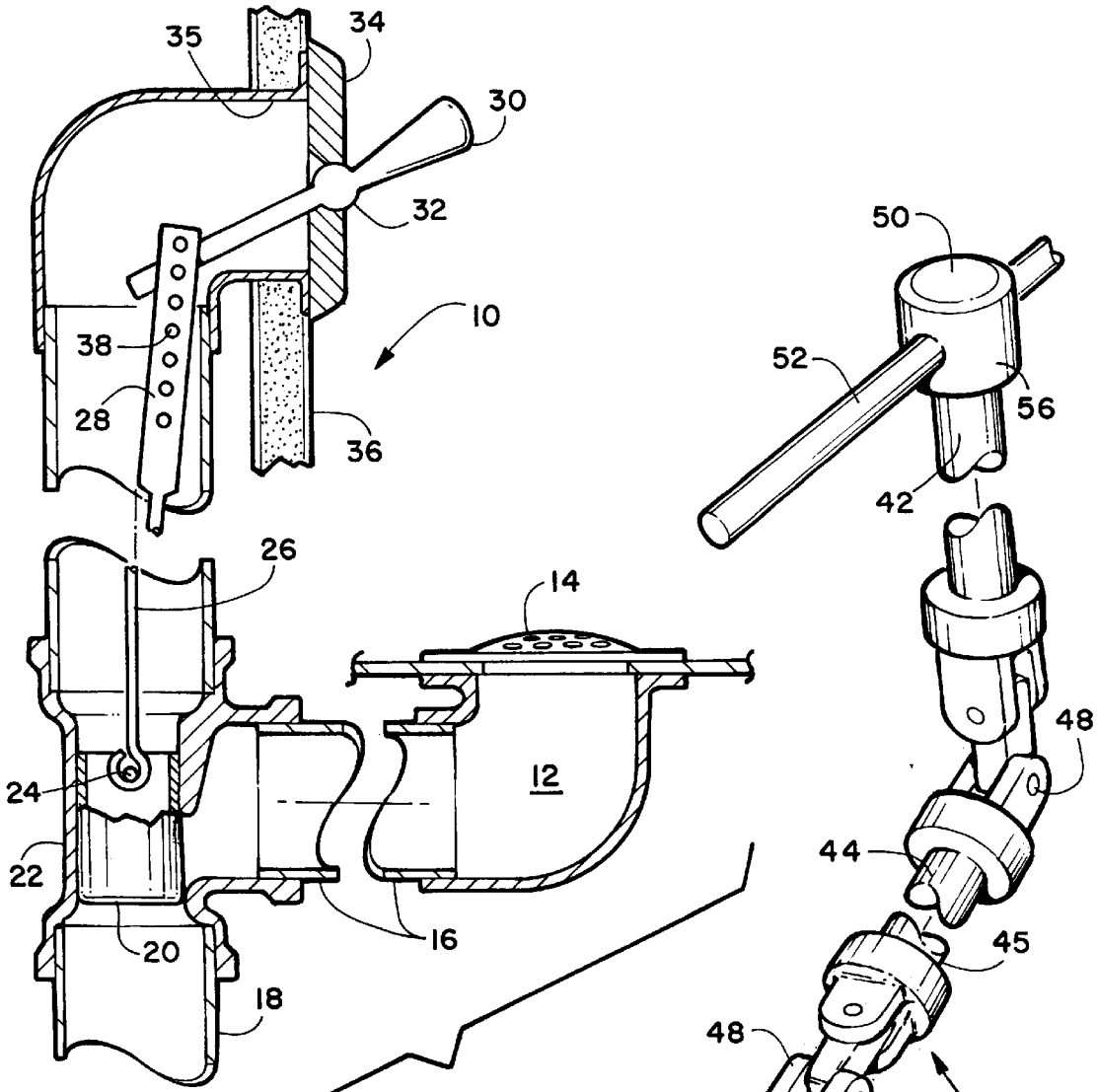
FIGURE 1 PRIOR ART
FIG. 1 is a side elevation view, partly cut away, showing a bath drain actuation system according to the prior art.
FIG. 3 is a perspective view of the tool nearing engagement with a bucket.

Referring to FIG. 1, there is seen a conventional bath drain system 10 including a drain opening 12 in a tub or tub/shower combination. The drain opening is covered by a grill 14. Drain water from drain opening 12 feeds through generally horizontal pipe 16 into vertical pipe 18.

In order to selectively shut off drain 12 to allow a tub to fill or opening the drain when the shower is used or to drain a tub, a generally tubular bucket 20 is slidably positioned in a sleeve 22 that extends across the entrance into pipe 18 from pipe 16. In the lower or "closed" position shown, flow into pipe 18 is blocked. Bucket 20 is a tight but sliding fit in sleeve 18 to prevent leakage of bath water when the drain is closed off.

Bucket 20 has a bar 24 across the top for connection to link 26. In some cases, an eye or various types of round or square stock may be provided for connection to link 26. Link 26 (which usually would be two or more links connected together) is connected to an adjustment plate 28. A trip lever 30, pivotable in a vertical plane about a pivot 32 in a cover plate 34 over opening 35 in end wall 36 of the tub is connected to one of the connection openings 38 by a bolt, rivet, pin or the like. The particular opening 38 connected to lever 30 is selected to provide the desired range of movement of bucket 20 in sleeve 22 as the lever is moved between upper and lower positions.

When the handle end of lever 30 is pushed down, bucket 20 is pulled up by adjustment plate 28 and links 26 to open the drain between pipes 16 and 18.

Often, people take showers rather than tub baths, so that lever 30 may be left for very long periods with bucket 20 in the upper "open" position. Corrosion and hard water deposits may form between bucket 20 and sleeve 22 or contaminants from the drain water may enter and fill the very small space between bucket and sleeve. This can make closing the drain by lowering bucket 22 to the position shown in FIG. 1 difficult or impossible.

Sometimes, vertical pipe 18 may become clogged below the drain connection. Hair, shampoo, hair conditioners and the like may accumulate. It is then necessary to break the clog loose with a plumbers snake. It is sometimes possible to introduce the snake through drain 12 after removing grill 14 and direct it into vertical pipe 18 with bucket 20 in the upper, open, position. However, the two right angle bends, between the drain entrance and horizontal pipe 16 and between horizontal pipe 16 and vertical pipe 18, together with the small entrance into pipe 18 if bucket 20 cannot be moved entirely out of the way may make snake introduction by this path very difficult or impossible.

A better snake introduction path is opened by removing cover 34 and pulling the assembly of adjustment plate 28, links 26 and bucket 20 out through opening 35. If bucket 20 is stuck in sleeve 22, efforts to pull the assembly out may fail, generally resulting in breaking the attachment loop of link 26 at bucket bar 24. Then an opening must be cut into the wall behind the tub or ceiling below the tub through which pipe 18 runs and the pipe must be disassembled. This is an expensive and time consuming operation.

The bucket retrieval tool 40 of this invention will permit easy, convenient retrieval of a stuck bucket 20 with little chance of damage to the drain assembly and without requiring breaking into the wall or ceiling below.

Figure 2:
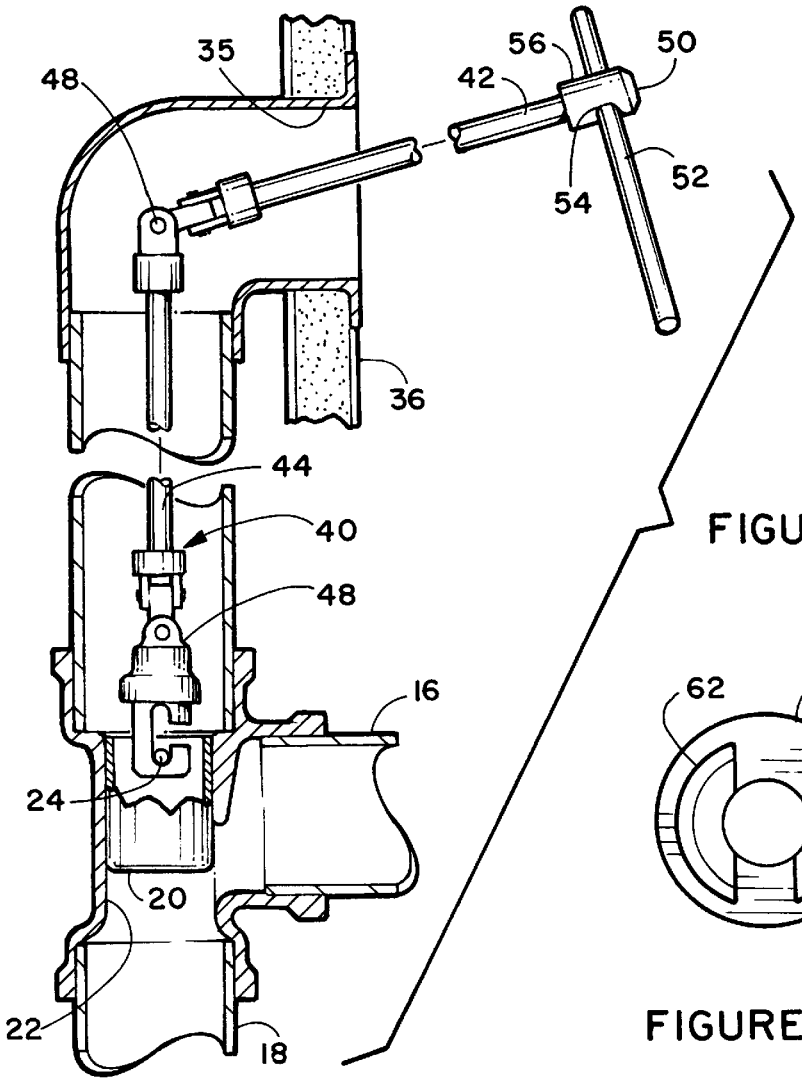
FIG. 2 is a side elevation view, partly cut away, showing the bath drain actuation system with the tool of this invention inserted for retrieving the bucket.

As seen in FIGS. 2 and 3, tool 40 includes a handle portion 42, at least two links, including a primal link 44, a distal link 45, and any desired additional links therebetween. A head 46 is connected through a universal joint 48 to distal link 45. A universal joint 48 is included between handle portion 42 and primal link 44 and between all additional links. For best results, from 2–4 links are used in seriatim.

A handle 50 at the primal end of handle portion 42 preferably consists of a rod 52 extending transversely through a hole 54 in end piece 56. Rod 52 can be slid through hole 54 to vary the lever arm provided by the rod. Any other suitable handle may be used, if desired.

Any suitable universal joints 48 may be used. Each link 44, 45 or additional link has universal joint components at each end and a shaft of selected length therebetween and has the appearance of links 44 and 45 combined without the break.

Figure 6:
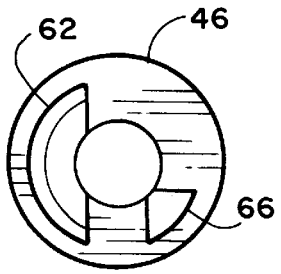
FIG. 6 is an end view of the tool head.
Figure 4:
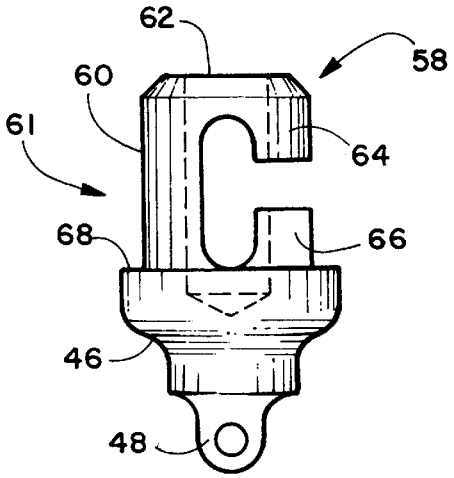
FIG. 4 is a side elevation view of the tool head.
Figure 5:
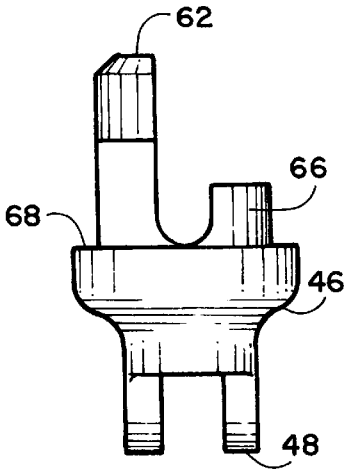
FIG. 5 is a front elevation view of the tool head.

The tool head 46, as seen in FIGS. 4–6, includes a universal joint connection 48 at the proximal end and a latching assembly 58 for engaging bar 24 of bucket 20. Latch assembly 58 engages bar 24 in a manner allowing the links 44 and 45 to be rotated both clockwise and counter clockwise by rotating handle 50 to break loose any corrosion or other material binding the bucket in place. Once bucket 20 is loose, latch assembly 58 hooks bar 24 in a manner allowing the bucket to be withdrawn upwardly through opening 35. A snake can be then inserted through opening 35 and has an approximately straight path down through vertical tube 18. A cleaned or replaced bucket 20 can then be inserted with new links 26 and trip lever 30 and cover 34 can be replaced.

Latching assembly 58 includes a generally hook-shaped means 61 including a post portion 60, a transverse segment 62 and a return segment 64. An upstanding peg 66 is spaced from hook shaped means 61. When the latching assembly is moved over bucket bar 24, as best seen in FIG. 3, the bar will engage the surface 68 of head 46 between post 60 and peg 66. Thus, when head 46 is rotated in either direction, post 60 and peg 66 will forcefully engage bar 24. By rotating assembly 40 and head 46 back and forth, bucket 20 will be gradually freed. Then by rotating head 46 clockwise (looking downwardly), bar 24 will abut post 60 below the hook formed by transverse segment 62 and return segment 64. Pulling up on links 44,45 with handle portion 42 will extract bucket 20 from sleeve 22 and through opening 35.

The distance between hook shaped member 61 and peg 66 is sufficient to receive the diameter of any conventional bucket bar 24. For convenience of manufacture and ease of insertion, head 46 is preferably turned to a generally cylindrical configuration, then is milled to the configuration shown.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A tool for retrieving generally tubular bath drain buckets having a cross bar, which comprises:

at least one link, said at least one link having proximal and distal ends;

a handle means connected to said proximal end of said at least one link;

universal joints between the proximal end of said at least one link and said handle means;

a head having a proximal end connected to said distal end of said at least one link;

said head having a distal end carrying a latching means for engagement with a bucket bar having a cross bar, said latching means comprises bucket cross bar engaging means to rotate said cross bar and bucket when said tool handle means is rotated and hook-like means for engaging said cross bar and retrieving said bucket;

whereby said handle means can rotate said tool to rotate a bucket clockwise and counter clockwise with said latching means engaged with a bucket bar and withdraw said bucket.

2. The tool according to claim 1 wherein said at least one link comprises from 2 to 4 links.

3. The tool according to claim 1 further comprising a proximal link series wherein said handle means comprises a bar slidable transverse to said proximal link series end through a link hole.

4. The tool according to claim 1 wherein said engaging means comprises an upstanding post and an upstanding peg on said head, said post and peg spaced for receiving said crossbar therebetween.

5. The tool according to claim 4 wherein said engaging means comprises a hook-like member having a transverse segment proximal end secured to a distal end of said post and a return segment secured to a distal end of said transverse segment and extending toward said head.

6. A tool for retrieving generally tubular bath drain buckets having a cross bar, which comprises:

a series of at least two links, said series of links having proximal and distal ends;

a handle means connected to said proximal end of said series of links;

universal joints between said links;

a head having a proximal end connected to said distal end of said series of links and a distal end extending away from said series of links;

a generally hook-shaped means on said head distal end for hooking a bucket bar so that pulling said handle means will withdraw said bucket;

an upstanding peg on said head distal end spaced from said hook-shaped means so that said hook-shaped means and said peg can engage opposite sides of a bucket bar and said bucket bar can be rotated clockwise and counter clockwise by rotating said handle means and series of links, whereby said handle means can rotate said tool to rotate a bucket clockwise and counter clockwise with said hook-shaped means engaged with a bucket bar and withdraw said bucket.

7. The tool according to claim 6 wherein said series of links is made up of from 2 to 4 links.

8. The tool according to claim 6 further comprising a series of links having a proximal end wherein said handle means comprises a bar slidable transverse to said proximal end of said series of said links through a link hole.

9. The tool according to claim 6 further including universal joints between said head and said distal end of said series of links and between said proximal end of said series of links and said handle means.

10. a tool for retrieving generally tubular bath drain buckets having a cross bar, which comprises:

a series comprising at least two connected links, said series of links having proximal and distal ends;

a handle means connected to said proximal end of said series of links;

universal joints between said links;

a head having a head distal end and a proximal end, said proximal end connected to said distal end of said series of links;

a first tool piece secured to said head distal end;

said first tool piece comprising:

a post having a first end secured to said head distal end and a second end extending away from said head distal end;

a transverse segment having a proximal end secured to said second end of said post and a distal end extending transverse to said post; and a return segment extending toward said head distal end from the distal end of said transverse segment, said return segment configured to provide a space between said return segment and said head distal end; and a second tool piece comprising an upstanding peg secured to said head distal end spaced from said first tool piece.

11. The tool according to claim 10 wherein said series of links is made up of from 2 to 4 links.

12. The tool according to claim 10 wherein said handle means comprises a bar slidable transverse to said proximal link series end through a link hole.

13. The tool according to claim 10 further including universal joints between said head and said distal end of said series of links and between said proximal end of said series of links and said handle means.

* * * * *